US005668517A

United States Patent [19]

Wong

[11] Patent Number: 5,668,517

[45] Date of Patent: Sep. 16, 1997

[54] SOLENOID IMPACT CONTROL DEVICE

[75] Inventor: Chee-Chiu J. Wong, Fairport, N.Y.

[73] Assignee: Xerox Corporation, Stamford, Conn.

[21] Appl. No.: 537,017

[22] Filed: Oct. 2, 1995

[51] Int. Cl.[6] ..... H01F 3/00; H01F 7/08

[52] U.S. Cl. ..... 335/257; 335/277; 271/117

[58] Field of Search ..... 335/247, 248, 335/257, 277; 271/117, 118, 273; 251/30.01–30.06, 129.01, 129.15

[56] References Cited

U.S. PATENT DOCUMENTS 3,455,536 7/1969 Barker ..... 251/129.01

4,782,862 11/1988 Nguyen ..... 251/129.01

5,157,448 10/1992 Lang ..... 355/309

*Primary Examiner*—Cassandra C. Spyrou

*Assistant Examiner*—Raymond Barrera

*Attorney, Agent, or Firm*—William A. Henry, II

[57] ABSTRACT

An apparatus that controls impact noise of a solenoid by energy dissipation through both resilient and pneumatic devices. This is achieved by providing a device between the plunger of the solenoid and a machine member. The device includes a predetermined number of orifices which are of different sizes and placed at different locations. This forms an air metering system and controls the stiffness of the device for maximum impact noise attenuation.

6 Claims, 4 Drawing Sheets

SOLENOID IMPACT CONTROL DEVICE

BACKGROUND OF THE INVENTION

This invention relates to a solenoid impact noise control mechanism for use in a wide variety of machines, for example, copier/printers.

Excessive noise from machines, such as, copier/printers in working environments has been an irritant to users from the advent of such machines until the present day. For example, a method of attenuating noise in photocopying equipment is disclosed in the Xerox Disclosure Journal, Vol. 4, Number 2, March/April, 1979, pg. 169, that includes molding in place open or closed cell polyurethane foam material directly onto the inside wall surfaces of aesthetic covers for both metal and plastic surfaces. One of the major contributors to machine noise has been found to be solenoids that are present in various machine systems. The impact of solenoid plungers, for example, in the document handlers of present day electrostatographic machines that are used to engage an idler roll assembly into engagement with a take-away roll shaft assembly are a source of impact noise and often leads to customer complaints. Machines with excessive impact noise are often perceived as having lower quality which affects market acceptance. A need clearly exists for a means to control solenoid impact noise in machines.

PRIOR ART

As commonly used, a solenoid is disclosed in U.S. Pat. No. 5,157,448 that prevents a reproduction machine paper loading drawer from opening during sheet feeding.

SUMMARY OF THE INVENTION

Accordingly, disclosed herein is an apparatus that controls impact noise of solenoids by energy dissipation through both resilient and pneumatic means. This is achieved by providing a device between the plunger of the solenoid and a machine member. The device in one embodiment includes a predetermined number of orifices which are of different sizes and placed at different locations. This forms an air metering system and controls the stiffness of the device for maximum impact noise attenuation. Alternatively, the device includes a looped shaped damper.

BRIEF DESCRIPTION OF THE DRAWINGS

All of the above-mentioned features and other advantages will be apparent from the example of one specific apparatus and its operation described hereinbelow. The invention will be better understood by reference to the following description of this one specific embodiment thereof, which includes the following drawing figures (approximately to scale) wherein.

DETAILED DESCRIPTION OF THE INVENTION

Figure 1:
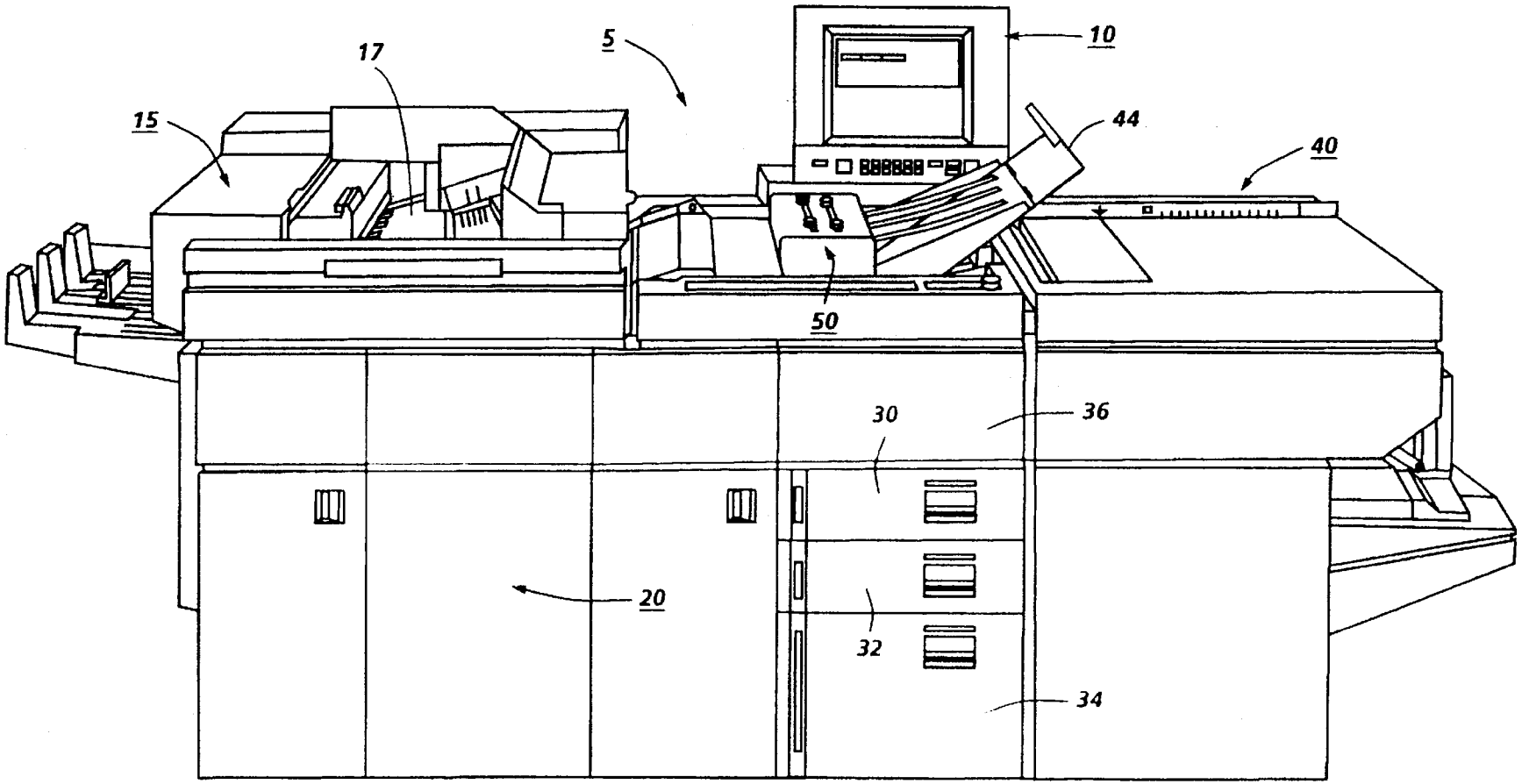
FIG. 1 is a schematic side view of an electrophotographic machine employing the solenoid impact control device of the present invention in a doccument handler of the machine.

For a general understanding of the features of the present invention, reference is made to the drawings. In the drawings, like reference numerals have been used throughout to identify identical elements. Referring to FIG. 1, there is shown an electrophotographic printing machine 5 composed of a plurality of programmable components and subsystems which cooperate to carry out the copying or printing programs through the touch dialogue User Interface (UI) 10. However, it should be understood that the apparatus of the present invention can be used as a standalone apparatus or with any device that feeds sheets, such as, a printer or in any environment where slitting or perforating is required.

Conventionally, machine 5 shown in U.S. Pat. No. 5,049,929 which is incorporated herein by reference, employs a recirculating document handler 15 having a document support surface 17 onto which documents are placed. The documents are fed individually to an imaging station where they are imaged within housing 20 onto a photoconductive belt corresponding to the informational areas contained within a document currently at the imaging station. After imaging, each document is returned to the document handler support surface 17 via a simplex path when either a simplex copy or the first pass of a duplex copy is being made or via a duplex path when a duplex copy is being made. Each image is developed on the photoreceptor, transferred and fused to copy sheets fed from either of paper trays 30, 32 or 34 through housing 36 to output tray 44 or finisher 40. If the slitting and/or perforating is not required, copy sheets pass through slitter/perforator 50 with it unactuated. The slitter/perforator is actuated by touching an icon on UI 10 in an appropriate location if there is a desire to slit or perforate copy sheets.

Figure 2:
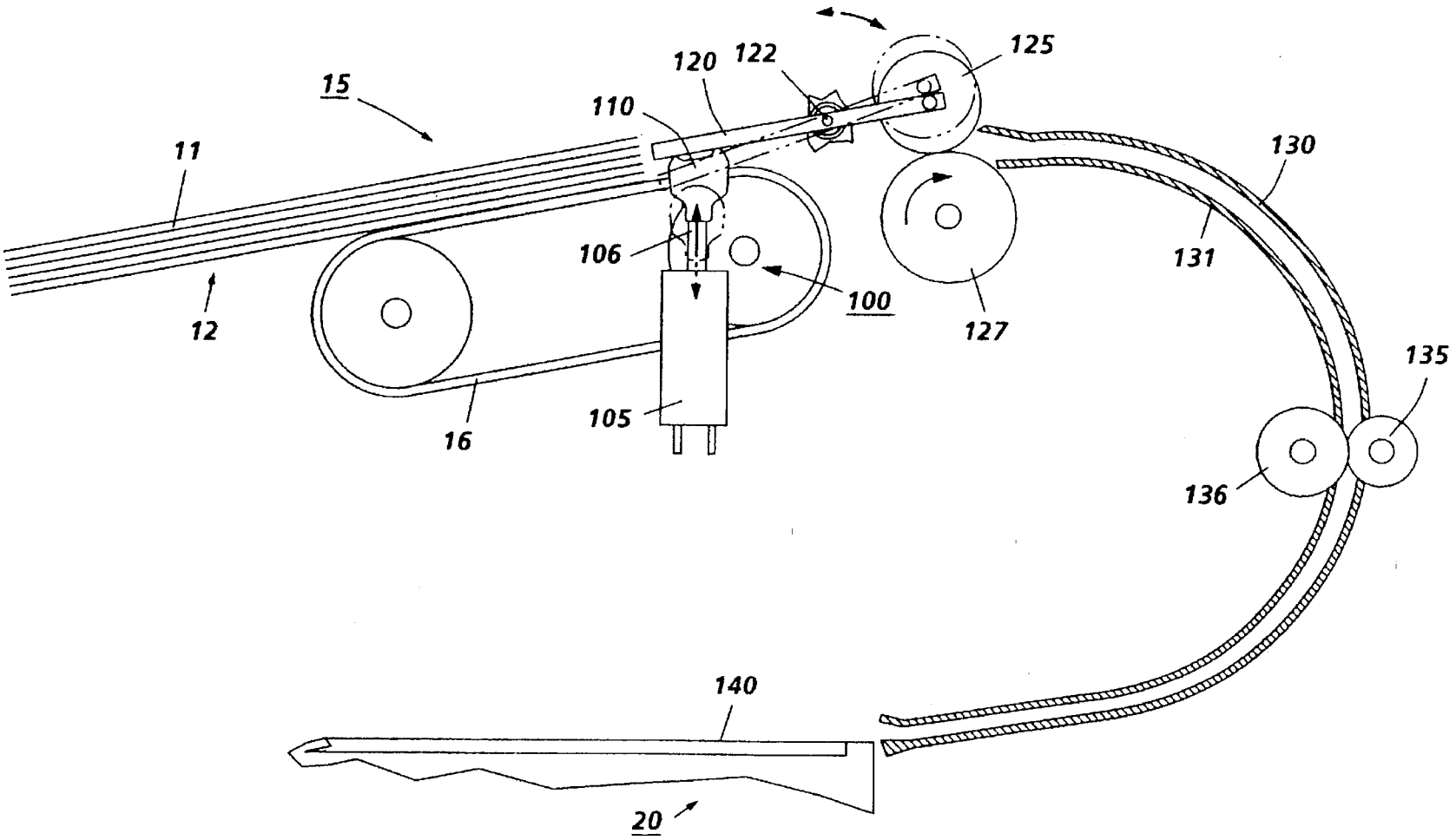
FIG. 2 is a partial schematic view of the document handler of the FIG. 1 machine showing the solenoid impact control device of the present invention.

As a set of original document is loaded into the document handler, each document is transported by the document handler to the top of processor where copies are made. Upon completion, the original document will be transported back to the top of the document handler. As shown more clearly in FIG. 2, and in accordance with the present invention, solenoid impact control device 100 is included in document handler 15. As the document handler acquires a document from the document set 11, the vacuum transport assembly 16 activates and pulls down the bottom sheet 12 of the set 11. Mounted to the document handler, a solenoid 105 activates and pushes its plunger 106 and deflectable bulb member 110 of the solenoid impact control device 100 in accordance with the present invention against an arm 120. Deflectable bulb member 110 can be of other shapes, such as, rectangular, elliptical, circular, etc., if desired. Bulb member 110 is preferably made of polyurethane, but can be made from polyurethane interconnecting cellular structure or other polymer material with variable cell size. This arm 120 is pivoting at a predetermined location 122 and connects with the take-away roll 125 at the other end. In motion, this arm 120 pushes the take-away roll 125 against an idler roll 127 which is in motion. A nip is formed. As the bottom sheet 12 of the document set 11 is fed into this nip, the nip will drive the sheet into and between the baffles 130 and 131. A nip formed between drive roll 135 and idler roll 136 receives the sheet driven by drive roll 125 and drives the sheet onto a platen (not shown) that is on top of housing 20 and underneath document handler 15.

In prior recirculating document handlers, the solenoid plunger 106 hits the pivoting arm 120 directly. This creates a loud noise. Impact noise of this take-away function was measured at 64 dBA. With solenoid impact control device 110 inserted in between the plunger 106 and pivoting arm 120, impact noise is virtually dissipated. Noise reduction of 96% (14 dB) was recognized in use of this system.

Figure 3:
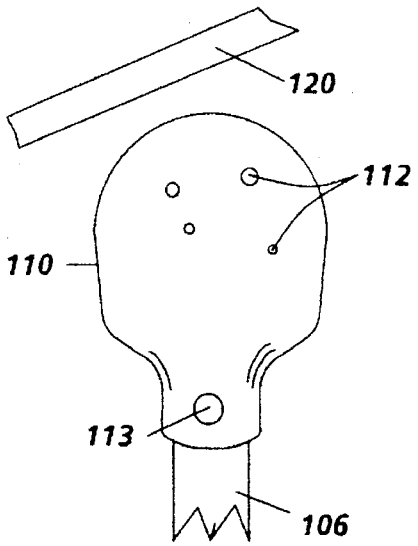
FIG. 3 is a schematic side view of the impact control device of FIG. 2.
Figure 4:
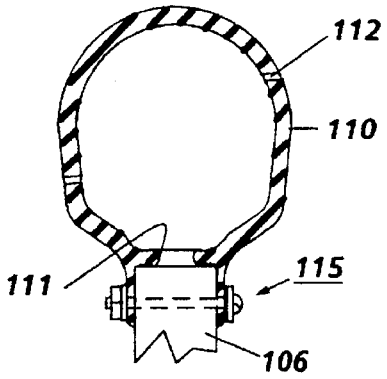
FIG. 4 is a schematic cross section of the impact control device of FIG. 3.

The objective of the solenoid impact control device 100 is to control impact noise by energy dissipation through both resilient and pneumatic means. This is achieved by providing a flexible, bulb shaped member 110 between plunger 106 of the solenoid 105 and pivoting arm 120 as shown in FIG. 3. The flexible, bulb shaped member 110 includes a predetermined number of orifices 112 which are of different sizes and placed at different locations. This forms an air metering system and controls the stiffness of the bulb member for maximum impact noise attenuation. Also, shown in FIG. 3 are the mounting holes 113 for standard mounting hardware. A lip 111, forms an integral part of the bulb member as shown in FIG. 4. Securing bulb 110 to plunger 106 of the solenoid 105 is assured by means of the lip 111, the mounting holes 113 and the mounting hardware 115.

Figure 5:
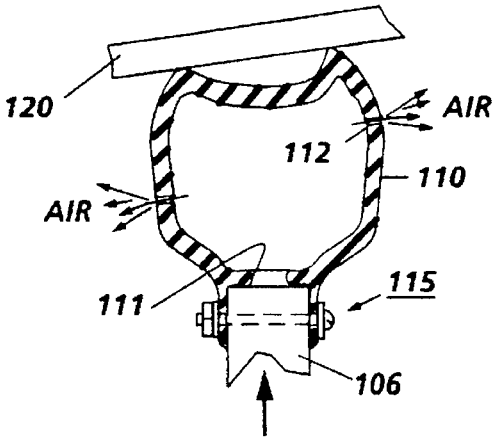
FIG. 5 is a schematic cross section of the impact control device of FIG. 3 at impact.
Figure 6:
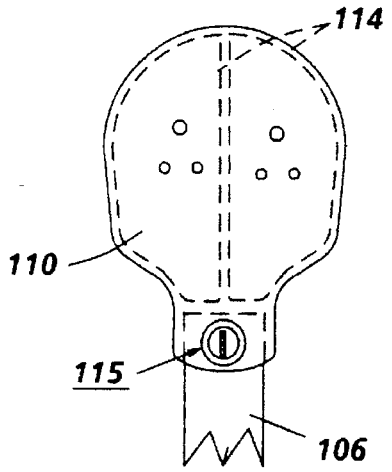
FIG. 6 is a schematic of the impact control device of FIG. 3 showing additional stiffen materials added.

As the solenoid 105 is activated, impact occurs between bulb shaped member 110 and pivoting arm 120 as shown in FIG. 5. The bulb shaped member will be compressed and deformed, thus absorbing and dissipating part of the impact energy. At the same time, the flow of air through the orifices 112 is controlled, this will do world and consume more impact energy. Consequently, impact noise is hardly audible. Elastic member 110 is preferably made of a resilient materials and may be convex in shape. Depending on the magnitude of the impact force and the space permitted, the performance of the bulb member can be optimized through at least six design parameters, including: the material properties; the material thickness and the size of the elastic member; the size of the orifices; the number of orifices; and the location of orifices. In some adverse situations, stiffeners 114, may be added for additional impact energy absorption as shown in FIG. 6.

Figure 7:
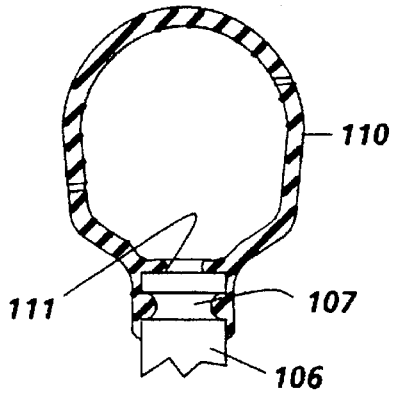
FIG. 7 is a schematic cross section of the impact control device of FIG. 3 showing a knob mounting mechanism.
Figure 8:
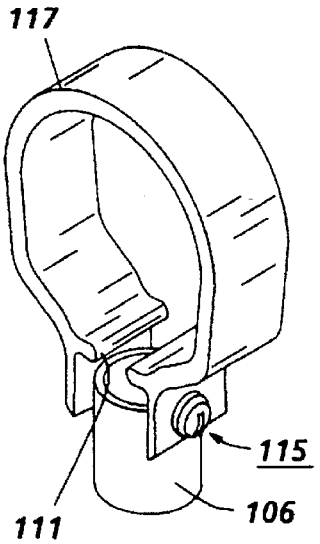
FIG. 8 is a schematic isometric view of an alternative embodiment of the impact control device of the present invention.
Figure 9:
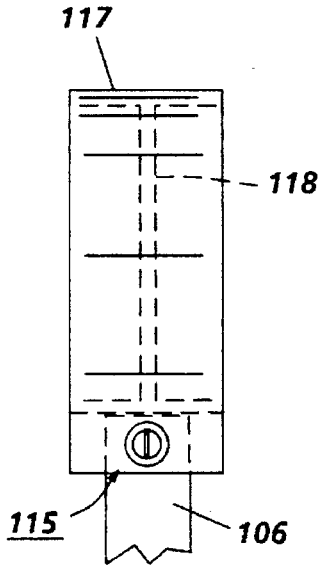
FIG. 9 is a schematic side view of the alternative embodiment of the impact control device of the present invention of FIG. 8 including added stiffening material.

A different embodiment of the present invention is shown in FIG. 7, where cost effective knob 107 is used in place of the standard mounting hardware 115 of FIG. 4. Another embodiment of the present invention is shown in FIG. 8 and comprises using a looped shape damper 117 for impact energy absorption. Stiffeners 118, can be added if necessary, as shown in FIG. 9.

As will be readily understood from the foregoing description, impact noise of solenoids is controlled by energy dissipation through both resilient and pneumatic means. This is achieved by providing a flexible device between the plunger of the solenoid and a machine member that is to be contacted by flexible device. The flexible device can comprises a predetermined number of orifices which are different sizes and placed at different locations. This forms an air metering system and controls the stiffness of the flexible device for maximum impact noise attenuation. Although this invention was reduced to practice in a document handler, this invention is applicable to any solenoid activated system where impact noise is a concern.

The invention has been described in detail with particular reference to the preferred embodiment thereof, but it will be understood that reasonable variations and modifications are possible without departing from the spirit and basic scope of the invention.

We claim:

1. In a solenoid actuation system including a solenoid for moving a work device, with the solenoid having a housing and a plunger adapted to move relative to the housing upon electrical actuation of the solenoid, the improvement in impact control, wherein:

said plunger is normally spaced from a work surface of said work device; and a resilient member connected between said plunger and the work surface and adapted to partially collapse between said plunger and work surface upon movement of said plunger toward said work surface to damp the impact of said plunger acting against said work surface and reduce noise resulting from contact of said resilient member against said work surface, said resilient member being adapted to restore to its original expanded shape upon removal of the solenoid force on said plunger, said resilient member comprising a hollow bulb with said hollow bulb including a predetermined number of orifices to enhance said partial collapse of said bulb, and wherein said predetermined number of orifices are of different sizes and spaced at different locations to reduce pneumatic noise from said partial collapse of said bulb.

2. A printing apparatus adapted to print page image information onto copy sheets and including a document handler that feeds original documents onto and off of a platen of the printing apparatus for imaging purposes, the document handler including a solenoid impact noise control system, comprising:

a solenoid for moving a work device with said solenoid including a housing and a plunger adapted to move relative to said housing upon electrical actuation of said solenoid;

a work surface, said work surface having an impact surface normally spaced from said solenoid; and a resilient member connected to an end of said plunger and adapted to collapse upon movement of said plunger against said impact surface of said work surface to damp the impact of said resilient member against said impact surface and thereby dissipate noise resulting from contact of said resilient member against said work surface.

3. The solenoid impact control device of claim 2, wherein said resilient member restores to its original expanded shape upon removal of the solenoid force on said plunger.

4. The solenoid impact control device of claim 3, wherein said resilient member comprises a bulb.

5. The solenoid impact control device of claim 4, wherein said bulb includes a predetermined number of orifices.

6. The solenoid impact control device of claim 3, wherein said resilient member comprises a looped shaped damper.

* * * * *